US007150046B2

(12) United States Patent
Böttger et al.

(10) Patent No.: US 7,150,046 B2
(45) Date of Patent: Dec. 19, 2006

(54) PROTECTIVE GARMENT

(75) Inventors: Christian Kurt Böttger, Remscheid (DE); Joe Krummel, Rising Sun, MD (US)

(73) Assignee: Teijin Twaron GmbH, Wuppertal (DE)

( * ) Notice: Subject to any disclaimer, the term of this patent is extended or adjusted under 35 U.S.C. 154(b) by 0 days.

(21) Appl. No.: 10/495,269

(22) PCT Filed: Oct. 19, 2002

(86) PCT No.: PCT/EP02/11735

§ 371 (c)(1),
(2), (4) Date: Jul. 23, 2004

(87) PCT Pub. No.: WO03/042622

PCT Pub. Date: May 22, 2003

(65) Prior Publication Data

US 2005/0066400 A1 Mar. 31, 2005

(30) Foreign Application Priority Data

Nov. 10, 2001 (EP) ..... 01126509

(51) Int. Cl.
*F41H 1/02* (2006.01)

(52) U.S. Cl. ..... 2/2.5; 442/134; 442/135

(58) Field of Classification Search ..... 2/2.5, 2/455, 102, 92; 428/911, 412, 920, 921; 89/36.01, 36.02, 36.05; 442/134, 286, 324, 442/326

See application file for complete search history.

(56) References Cited

U.S. PATENT DOCUMENTS

| | | | | |
|---|---|---|---|---|
| 3,641,638 | A * | 2/1972 | Laible | 28/112 |
| 3,924,038 | A * | 12/1975 | McArdle et al. | 428/49 |
| 4,574,105 | A * | 3/1986 | Donovan | 442/247 |
| 5,733,620 | A * | 3/1998 | Baader et al. | 428/605 |
| 6,003,424 | A * | 12/1999 | Cordova et al. | 89/36.02 |
| 6,276,254 | B1 * | 8/2001 | Cordova et al. | 89/36.02 |
| 6,475,936 | B1 * | 11/2002 | Chiou | 442/203 |
| 6,534,426 | B1 * | 3/2003 | Chiou | 442/203 |
| 6,668,868 | B1 * | 12/2003 | Howland et al. | 139/383 R |
| 2002/0173210 | A1 * | 11/2002 | Kim | 442/261 |

FOREIGN PATENT DOCUMENTS

| | | |
|---|---|---|
| WO | WO 98/02607 | 1/1998 |
| WO | WO 00/08411 | 2/2000 |

* cited by examiner

*Primary Examiner*—Gary L. Welch
*Assistant Examiner*—Andrew W. Sutton
(74) *Attorney, Agent, or Firm*—Oliff & Berridge, PLC

(57) ABSTRACT

Protective clothing comprises at least one protective material including an array of one or more superposed layers of woven fabric, wherein each fabric layer is flexible and includes at least one fabric, made of yarns having a strength of at least 900 MPa, that is joined to at least one polymer film, and wherein the protective material has an outer surface facing the side of attack and an inner surface facing away from the side of attack, wherein the protective material also has at least one layer of felt, placed in every case on one of the fabric layers.

19 Claims, No Drawings

PROTECTIVE GARMENT

CROSS-REFERENCE TO RELATED APPLICATION

This application is a U.S. national stage application of International Application No. PCT/EP02/11735 filed on Oct. 19, 2002, the disclosure of which is incorporated by reference herein in its entirety.

BACKGROUND OF THE INVENTION

1. Field of the Invention

The invention relates to protective clothing comprising at least one protective material.

2. Description of Related Art

Clothing that protects against attack with ballistic or stab weapons is known. WO 00/08411 describes a stab-resistant material comprising at least two woven fabrics joined via a polymer film, wherein the fabrics consist of yarns having a strength of at least 900 MPa and the polymer film joining the fabrics has a strength of at least 10 MPa and a flexural modulus of 1500 to 4500 MPa.

While the material disclosed in WO 00/08411 offers good stab resistance, a need exists for protective clothing of a protective material that ensures even better protection for the same areal weight. Protective clothing of this type would have the additional advantage that a particular measure of protection would be attainable with a lower areal weight than has previously been possible, leading to a higher degree of comfort for the wearer.

SUMMARY OF THE INVENTION

The object of the present invention, therefore, is to provide protective clothing of a protective material that ensures improved protection for the same areal weight, or the same degree of protection for a lower areal weight.

This object is achieved by protective clothing comprising at least one protective material comprising an array of one or more superposed fabric layers, wherein each fabric layer is flexible, and consists of at least one fabric, made of yarns having a strength of at least 900 MPa, that is joined to at least one polymer film, and wherein the protective material has an outer surface facing the side of attack and an inner surface facing away from the side of attack and is characterized in that it also has at least one layer of felt, placed in every case on one of the fabric layers.

DETAILED DESCRIPTION OF PREFERRED EMBODIMENTS

It has surprisingly been found that owing to the protective material containing in addition at least one further layer of felt, which is positioned in every case on one of the fabric layers, protective clothing is achieved that, for the same areal weight, provides improved protection and therefore makes it possible to ensure the same degree of protection for a lower areal weight, i.e., for greater wear comfort.

The description that the protective material of the protective clothing of the invention further has at least one additional felt layer that is always positioned on one of the fabric layers means that the at least one layer of felt is sewed or stuck to the fabric layer only at discrete points, or is simply superposed on it. This superposed embodiment is preferred on account of simplicity of implementation.

Protective clothing that offers especially effective protection, and is therefore preferred according to the invention, is one in which at least one layer of felt is positioned at the outer surface and/or the inner surface of the protective material.

Another embodiment of the protective clothing of the invention that offers especially effective protection, and is therefore preferred, is one comprising at least three fabric layers and having at least one felt layer positioned between the fabric layers, and in which the number of fabric layers facing the outer surface is lower than the number of fabric layers facing the inner surface.

It is advantageous if, in the protective clothing of the invention, the at least one felt layer consists of an aromatic polyamide, i.e., of an aramid, and in particular of a p-aramid.

The felt layer can be produced by any of the known manufacturing methods for felts, resulting in a layer of felt that is bonded, for example, thermally, by the action of a stream of water or air, or by needling. The felt layer is preferably a needled felt. A felt of this type can be obtained from, for example, Job (Kinna, Sweden).

Furthermore, it is preferred for the protective clothing of the invention that each fabric of each fabric layer consist of yarns of strength between 900 and 8000 MPa, more preferably between 1500 and 6000 MPa and most preferably between 3000 and 6000 MPa. Practically all yarns, including those suitable for use in ballistic protection, such as yarns made from polyolefins, particularly polyethylene, or yarns of polyamide, polyimide, polyester or poly(p-phenylene-2,6-benzobisoxazole) have strengths in this range. Yarns from aramids, especially those from p-aramids, have proved particularly favorable.

It has proved most favorable in the protective clothing of the invention for the weave of each fabric of each fabric layer to be a plain weave.

It has further proved most favorable in the protective clothing of the invention for each fabric of each fabric layer to have a fabric density, as calculated by the Walz formula, of between 15% and 80%, and preferably between 15% and 60%.

The Walz fabric density is calculated from the formula $$DG=(d_k+d_s)^2 \cdot f_k f_s$$

where $d_k$=substance diameter of the warp yarn in mm $d_s$=substance diameter of the weft yarn in mm $f_k$=warp threads per cm $f_s$=weft threads per cm.

The substance diameter $d_k$ or $d_s$ of the yarns is calculated as follows:

$$d=(\text{titre})^{1/2}/[88.5(\text{density})^{1/2}]$$

where d is either $d_k$ or $d_s$, the titre of the corresponding yarn is in dtex, and the density of the yarn is in g/cm$^3$.

The values given above apply particularly for fabrics with a plain weave. For weaves other than a plain weave, a weave correction factor must be included in the calculation. The following are examples of the values used for the weave correction factor for fabrics with specific weaves:

| Weave type | Weave correction factor |
|---|---|
| 2/2 hopsack weaves | 0.56 |
| 2/1 twill weaves | 0.70 |

-continued

| Weave type | Weave correction factor |
|---|---|
| 2/2 twill weaves | 0.56 |
| 3/1 twill weaves | 0.56 |
| 4/4 twill weaves | 0.38 |
| 1/4 satin | 0.49 |

The fabric density DG as calculated by the Walz formula is multiplied by these correction factors.

The fabric density DG according to Walz is expressed as a percentage. In case of highly dense fabrics the values may lie above 100%.

The fact that in the protective clothing of the invention each fabric layer consists of at least one fabric joined to at least one polymer film means, for example, that one fabric is joined to one polymer film. Either the fabric or the polymer film can lie closer to the outer surface of the protective material that faces the side of attack.

In a preferred embodiment of the protective clothing of the invention, each fabric layer consists of a fabric joined on both sides to a polymer film.

In another preferred embodiment of the protective clothing of the invention, each fabric layer consists of two fabrics, joined via a polymer film, whereby it has proved particularly advantageous for each fabric layer to consist of two fabrics laminated to each other by a polymer film.

It is advantageous if the polymer film joining the two fabrics of the layer has an elongation at break of at least 80%, for example, 100% or 120%.

In the present invention, in a same manner as described in WO 00/08411, the flexural modulus should be determined in accordance with ASTM D-790, the strength of the film in accordance with ASTM D-638, the elongation at break in accordance with ASTM D-638 and the strength of the yarn in accordance with ASTM D-885.

The polymer film contained in the protective clothing of the invention has a strength preferably of at least 10 MPa and a flexural modulus of 1500–4500 MPa. A flexural modulus of 2000–3000 MPa is especially favorable. Suitable polymers are hard PVCs having a flexural modulus between 3500 and 4000 MPa, or polyurethanes having a flexural modulus between 4000 and 4500 MPa.

Polymer films made from a polycarbonate are particularly suitable for binding the fabrics into a fabric layer. A polycarbonate of this type is sold, for example, under the name POKALON N 38 by Color Print (Frankenthal, Germany). A further example of a suitable polycarbonate is sold under the name LEXAN 103 by GE Plastics. LEXAN 103 has a flexural modulus of 2500 MPa, a strength of 70 MPa and an elongation at break of 120%.

It has been found that particularly good protection is afforded by the protective clothing of the invention that comprises a protective material consisting of an array of several superposed fabric layers, wherein a layer of felt is placed on both the outer surface and the inner surface. This embodiment is therefore preferred, particularly when the protective material comprises an array of 6 to 30 superposed fabric layers, whereby it is most especially preferred, from the viewpoints of protective efficiency and wear comfort, that the protective material comprises an array of 6 to 25 superposed fabric layers.

A further preferred embodiment of the present invention consists in protective clothing comprising at least two of the protective materials described above.

In the protective clothing of the invention, a protective material, or several or all of the protective materials, are preferably placed in a sheath of textile material, because this allows for easier handling.

The invention will now be described in more detail with the help of the following examples. The protective efficiency will be illustrated by means of the stab resistance shown by the protective materials of the protective clothing of the invention. The stab resistance was tested in accordance with NIJ (National Institute of Justice) standard 0115.00, protection level KR 2, wherein a spike is dropped on to the stab-resistant material by means of a drop tester. The stab-resistant material is affixed by means of a tensioning strap to a background material consisting of various foams defined in the aforementioned standard. The spike falls on to the stab-resistant material, pierces it, and penetrates a certain distance into the background material. The background material penetration is measured in mm, and the arithmetic mean determined for several drops. Unlike in the aforementioned standard, this mean value is designated as the stab resistance.

EXAMPLES 1 TO 6

Fabrics were produced in a plain weave from aramid yarns with a titre of 930 dtex and a breaking strength of 3380 MPa. The fabrics contained approximately the same number of threads in warp and weft. The Walz fabric density was 18.5%, and the fabric weight was 140 g/m$^2$. A polycarbonate polymer film (POKALON N 38, from Color Print, Frankenthal, Germany) having an areal weight of 75 g/m$^2$ was placed between two prewashed fabrics. Lamination of the two fabrics to the polymer film to give a fabric layer was carried out in a temperature range of 220–230° C. and at a pressure of approximately 100 bar.

In Example 1, 16 of the aforementioned fabric layers were superposed and then secured with a tensioning strap to the background material, and the stab resistance was measured as described above.

In Example 2, 16 layers of felt were superposed and secured with a tensioning strap to the background material, and the stab resistance was measured as described above. Each felt layer consists of a 100% p-aramid felt whose fibers consist of TWARON® fibers of titre 1.7 dtex and length 60 mm. These fibers are available from Teijin Twaron. The felt has an areal weight of 350 g/m$^2$, is needled and calendered, and has a thickness of 2.3 mm. A felt of this type is available from Job (Kinna, Sweden).

In Example 3, 14 of the aforementioned fabric layers are laid on two of the layers described immediately above. The protective material of the invention that is thus formed is secured with a tensioning strap to the background material with the felt layers facing the background material, and the stab resistance is measured as described above.

In Example 4, two of the layers of felt described immediately above are placed on 14 of the aforementioned fabric layers. The protective material of the invention that is thus formed is secured with a tensioning strap to the background material with the fabric layers facing the background material, and the stab resistance is measured as described above.

In Example 5, one of the layers of felt described immediately above is placed on 15 of the aforementioned fabric layers. The protective material of the invention that is thus formed is secured with a tensioning strap to the background material with the fabric layers facing the background material, and the stab resistance is measured as described above.

In Example 6, 14 of the aforementioned fabric layers are placed on one of the felt layers described immediately above, and one of the felt layers described immediately above is placed on the 14 fabric layers. The protective material of the invention that is thus formed is secured with a tensioning strap to the background material, and the stab resistance is measured as described above. The constitution of the tested materials, their areal weights, their individual penetration values and their arithmetic means that, as stated above, are designated as the stab resistance, unlike in the aforementioned standard, are given in the following table. The lower the value in the stab resistance column, the better is the stab resistance.

| Example | Constitution | Areal weight ($g/m^2$) | Individual penetration values (mm) | Stab resistance (mm) |
|---|---|---|---|---|
| 1 | 16 fabric layers | 5680 | 26, 28, 29 | 27.7 |
| 2 | 16 felt layers | 5600 | approx. 25 | approx. 25 |
| 3 | 14 fabric layers<br>2 felt layers | 5670 | 29, 26, 17, 32 | 26.0 |
| 4 | 2 felt layers<br>14 fabric layers | 5670 | 22, 15, 24, 23 | 21.0 |
| 5 | 1 felt layer<br>15 fabric layers | 5675 | 12, 20, 18, 30, 16, 13, 16, 17 | 17.8 |
| 6 | 1 felt layer<br>14 fabric layers<br>1 felt layer | 5670 | 0, 14, 14, 10, 19, 0, 27, 15 | 12.4 |

The table shows that substitution of even one fabric layer by a felt layer significantly improves the stab resistance (as is seen from comparison of Examples 1 and 5).

In general, the stab resistance in those protective materials where the felt layer is placed on the outer surface, facing the falling spike, is better than in those protective materials where the felt layer is placed on the inner surface, facing the background material (as is seen from comparison of Examples 3 and 4).

The best stab resistance was attained with the protective material of Example 6. For the two individual tests that gave individual penetration values of 0 mm, the spike was even found to be bent. Applied to a real-life threatening situation, i.e., in an attack with a stab weapon similar to the spike, this result means that with the use of 16 fabric layers of the prior art, the spike would penetrate the body to a depth of approximately 28 mm (see Example 1), while with the protective material of the invention of Example 6 the spike would penetrate the body to only about 12 mm, i.e. 16 mm less deep. Moreover, the areal weight of the protective material according to the invention is, at 5670 $g/m^2$, even somewhat lower than that of the aforementioned 16 fabric layers of the prior art (5680 $g/m^2$). Consequently, a protective material according to the invention can be provided with a stab resistance of 28 mm and an areal weight significantly lower than 5680 $g/m^2$. Thus, for the same stab resistance of 16 fabric layers of the prior art, the protective material of the invention offers significantly better wear comfort.

EXAMPLE 7

Using the spike specified in the aforementioned NIJ standard, which was fixed in a handle, a tester, using the maximum force, made three stabs manually on each of the following:

a) 15 superposed fabric layers, produced as described in the first paragraph of Examples 1–6, and b) a protective material of the invention, comprising 9 superposed fabric layers, produced as in the first paragraph of Examples 1–6, a felt layer produced as in Example 2 being placed on the outer surface, facing the side of attack.

The test materials in this case were placed on the same background material as specified in the aforementioned NIJ standard, but were not secured to it.

Whereas in a) the spike clearly penetrated the 15 fabric layers, no penetration was detected in b) and the spike was even bent.

The invention claimed is:

1. Stab-resistant clothing comprising at least one protective material comprising an array of one or more superposed woven fabric layers, wherein each fabric layer is flexible, and includes at least one fabric, made of yams having a strength of at least 900 MPa, that is joined to at least one polymer film, and wherein the protective material has an outer surface facing the side of attack and an inner surface facing away from the side of attack, wherein the protective material also has at least one layer of felt, placed on one of the fabric layers, and wherein the protective material includes at least one additional layer of felt, positioned on one of the fabric layers.

2. Stab-resistant clothing according to claim 1, wherein at least one layer of felt is positioned at least at one of the outer surface and the inner surface of the protective material.

3. Stab-resistant clothing according to claim 1 further comprising at least three fabric layers, wherein at least one layer of felt is positioned between the fabric layers, the number of fabric layers from the at least one felt layer to the outer surface being lower than the number of fabric layers from the at least one felt layer to the inner surface.

4. Stab-resistant clothing according to claim 1, wherein the at least one layer of felt includes an aromatic polyamide.

5. Stab-resistant clothing according to claim 1, wherein the at least one layer of felt is a needled felt.

6. Stab-resistant clothing according to claim 1, wherein each fabric of each fabric layer includes yarns of strength between 900 and 8000 MPa.

7. Stab-resistant clothing according to claim 1, wherein the weave of each fabric of each fabric layer is a plain weave.

8. Stab-resistant clothing according to claim 1, wherein each fabric of each fabric layer has a fabric density, as calculated by the Walz formula, of between 15% and 80%.

9. Stab-resistant clothing according to claim 1, wherein each fabric layer includes a fabric that is joined on both sides to a polymer film.

10. Stab-resistant clothing according to claim 1, wherein each fabric layer includes two fabrics joined to each other via a polymer film.

11. Stab-resistant clothing according to claim 10, wherein each fabric layer includes two fabrics laminated to each other by a polymer film.

12. Stab-resistant clothing according to claim 1, wherein the polymer film has a strength of at least 10 MPa and a flexural modulus of 1500–4500 MPa.

13. Stab-resistant clothing according to claim 12, wherein the polymer film has a flexural modulus of 2000–3000 MPa.

14. Stab-resistant clothing according to claim 1, wherein the polymer film binding the fabrics into a fabric layer includes a polycarbonate.

15. Stab-resistant clothing according to claim 1, wherein the protective material includes an array of several superposed fabric layers, a layer of felt being placed on both the outer surface and the inner surface of the protective material.

16. Stab-resistant clothing according to claim 15, wherein the protective material further comprises an array of 6 to 30 superposed fabric layers.

17. Stab-resistant clothing according to claim 15, wherein the protective material further comprises an array of 6 to 25 superposed fabric layers.

18. Stab-resistant clothing according to claim 1 composing at least two protective materials.

19. Stab-resistant clothing according to claim 1, wherein one or more of the at least one protective material is placed in a sheath of textile material.

* * * * *

UNITED STATES PATENT AND TRADEMARK OFFICE

CERTIFICATE OF CORRECTION

PATENT NO. : 7,150,046 B2
APPLICATION NO. : 10/495269
DATED : December 19, 2006
INVENTOR(S) : Christian Kurt Böttger It is certified that error appears in the above-identified patent and that said Letters Patent is hereby corrected as shown below:

Title page, item 56 under Foreign Application Priority Data, "(EP) 01126509" should be --(EP) 01126509.7--.

Signed and Sealed this

Sixth Day of March, 2007

JON W. DUDAS
*Director of the United States Patent and Trademark Office*